US012678911B2

(12) United States Patent
Brandstetter

(10) Patent No.: US 12,678,911 B2
(45) Date of Patent: Jul. 14, 2026

(54) HONING TOOL AND HONING STICK

(71) Applicant: KADIA Produktion GmbH + Co., Nürtingen (DE)

(72) Inventor: Jochen Brandstetter, Kirchheim/Teck (DE)

(73) Assignee: KADIA Produktion GmbH + Co., Nürtingen (DE)

( * ) Notice: Subject to any disclaimer, the term of this patent is extended or adjusted under 35 U.S.C. 154(b) by 340 days.

(21) Appl. No.: 18/275,627

(22) PCT Filed: Jan. 17, 2022

(86) PCT No.: PCT/EP2022/050883
§ 371 (c)(1),
(2) Date: Aug. 3, 2023

(87) PCT Pub. No.: WO2022/167204
PCT Pub. Date: Aug. 11, 2022

(65) Prior Publication Data

US 2024/0123564 A1 Apr. 18, 2024

(30) Foreign Application Priority Data

Feb. 5, 2021 (DE) ..... 102021201071.7

(51) Int. Cl.
*B24B 33/08* (2006.01)

(52) U.S. Cl.
CPC ..... *B24B 33/082* (2013.01)

(58) Field of Classification Search
CPC ..... B24B 33/02; B24B 33/105; B24B 33/00; B24B 33/08; B24B 33/082; B24B 33/083;
(Continued)

(56) References Cited

U.S. PATENT DOCUMENTS 2,823,498 A * 2/1958 Saunders ..... B24B 33/086 451/540
2,952,952 A 9/1960 Stanhope
(Continued)

FOREIGN PATENT DOCUMENTS

CN 102240961 A 11/2011
DE 296 16 300 U1 12/1996
(Continued)

OTHER PUBLICATIONS

PE2E Translation DE 202011105719; Honing Tool; Dec. 16, 2011 (Year: 2011).*
(Continued)

*Primary Examiner* — Brian D Keller
*Assistant Examiner* — Sidney D Full
(74) *Attorney, Agent, or Firm* — DLA Piper LLP (US)

(57) ABSTRACT

A honing tool includes a tool body which is tubular at least in certain portions and includes a cutting region with at least one honing stick receiving opening which is continuous from the interior of the tool body to the outside and is intended for receiving a honing stick, wherein dimensions of the honing stick receiving opening and of the honing stick are matched to one another such that the honing stick is received radially movably, and substantially without play in the circumferential direction of the tool body, between boundary surfaces of the honing stick receiving opening. The honing tool comprises a honing stick retaining system designed such that the honing stick is held in the honing stick receiving opening by the honing stick retaining system.

8 Claims, 2 Drawing Sheets

(58) Field of Classification Search
CPC ... B24B 33/084; B24B 33/085; B24B 33/086; B24B 5/40; B25G 3/28; B25G 3/20; B25B 23/0014; B25B 23/0035; F16B 2/16
USPC ..... 451/478; 81/177.75; 464/119, 139
See application file for complete search history.

(56) References Cited

U.S. PATENT DOCUMENTS

| | | | | |
|---|---|---|---|---|
| 3,037,333 | A | 6/1962 | Stelmachowski | |
| 3,138,902 | A * | 6/1964 | Crowe | B24B 33/086 451/478 |
| 3,507,077 | A * | 4/1970 | Magsig | B24B 33/08 451/470 |
| 3,810,333 | A | 5/1974 | Gillette | |
| 4,471,576 | A | 9/1984 | Corley | |
| 2011/0223843 | A1 | 9/2011 | Wiederhold | |
| 2014/0113535 | A1 | 4/2014 | Baumgartner et al. | |

FOREIGN PATENT DOCUMENTS

| | | | | |
|---|---|---|---|---|
| DE | 202011105719 | U1 * | 12/2011 | B24B 41/007 |
| DE | 202012103152 | U1 * | 9/2012 | B25B 23/0035 |
| DE | 10 2013 221 220 | A1 | 5/2014 | |
| DE | 102014225164 | A1 | 6/2016 | |
| EP | 2 364 813 | A2 | 9/2011 | |

OTHER PUBLICATIONS

DE 202012103152 PE2E Translation; Fixing Mechanism for the Sleeve of Hand Tools; Sep. 17, 2012 (Year: 2012).*
International Search Report dated Apr. 25, 2022 in counterpart International Application No. PCT/EP2022/050883 w/English translation.
Written Opinion dated Apr. 25, 2022 in counterpart International Application No. PCT/EP2022/050883.
Office Action dated Jun. 29, 2025, from counterpart Chinese Patent Application No. 202280013458.3.

* cited by examiner

HONING TOOL AND HONING STICK

TECHNICAL FIELD

This disclosure relates to a honing tool and a honing stick that can be used to produce such a honing tool.

BACKGROUND

Honing is a cutting method with geometrically undefined cutting edges in the course of which method a honing tool performs a cutting movement consisting of two components inside a bore that is to be machined and there is continuous surface contact between one or more cutting material elements of the honing tool and the bore inner surface that is to be machined. The kinematics of an expandable honing tool are characterized by the superposition of a rotary movement, a usually oscillating reciprocating movement which runs in the axial direction of the bore, and an adjusting movement, which leads to a change in the effective diameter of the honing tool. A surface structure with intersecting machining traces is produced on the bore inner surface. Honing makes it possible for finished surfaces to satisfy high requirements in respect of dimensional and shape tolerances so that many sliding surfaces that are subjected to high loads can be machined by honing in engines or engine components, e.g., cylinder running surfaces in engine blocks or bore inner surfaces in housings for injection pumps.

Especially in the event of machining bores with relatively small diameters, for example, in the range of 15 mm or less, use is made of honing tools having a tool body which is tubular at least in certain portions and comprises a cutting region with at least one honing stick receiving opening which is continuous from the interior of the tool body to the outside and is intended for receiving a honing stick. In that structure, the tool body serves as receptacle for one or more honing sticks and at the same time as guide for an adjusting rod, which serves for radial adjustment of the honing sticks. The honing tool comprises a device for detachable fastening of the honing tool to the working spindle of a honing machine.

The dimensions of the generally rectangular honing stick receiving opening and the corresponding cross-sectional dimensions of the honing stick are matched to one another such that the honing stick is received radially movably, and substantially without play in the circumferential direction of the tool body, between boundary surfaces of the honing stick receiving opening. In this respect, it is usually attempted to realize a sliding fit by exact machining of the boundary surfaces of the honing stick receiving opening and the corresponding side surfaces of the honing stick, with the result that the honing stick can just still be inserted manually into the honing stick receiving opening and is held there by frictional forces between side surfaces of the honing stick and adjoining boundary surfaces of the honing stick receiving opening.

The inner side, which projects into the interior of the tool body, of the honing stick generally has a sloping surface, which interacts with a corresponding sloping surface at the end of the adjusting rod in the manner of a wedge drive such that an axial displacement of the adjusting rod in relation to that end of the tool body that is further away from the spindle displaces the honing stick radially outward.

In particular, after a lengthy period of use of the honing tool, it is possible for honing sticks to fall out of the honing stick receiving opening when the honing tool is withdrawn from the bore that is machined. The honing stick may possibly also be forced out of the honing stick receiving opening by centrifugal forces if the working spindle still rotates relatively quickly after the withdrawal operation. To prevent honing sticks from falling out or being forced out, different honing stick retaining systems have been developed.

In some instances, what are referred to as stick catch bushings are used. They are substantially sleeve-shaped components which are guided in a sliding movement on the tool body above the cutting region and, owing to their inherent weight, slide over the cutting region with the honing sticks when the honing tool is withdrawn from the bore.

Other examples of solutions that can act as honing stick retaining system are described, for example, in DE 296 16 300 U1, U.S. Pat. Nos. 2,952,952 A, 3,037,333 A, 3,810,333 A and 4,471,576 A.

EP 2 364 813 A2 describes a honing tool with a honing stick retaining system comprising an elastically compressible retaining element, which is fastened to and can be installed together with the honing stick. In one example, the retaining element used is an elongate piece which consists of a flexible silicone tube, is inserted into a milled elongate groove on a side surface of the honing stick, and in the installed state of the honing stick is supported, with a pressing force, on the one hand against that side surface of the honing stick that is provided with the groove and on the other hand against a boundary surface of the honing stick receiving opening that is situated opposite the side surface. In the process, the pressing force is generated by compressing the retaining element. The honing stick is then held in the honing stick receiving opening by frictional engagement. This solution functions reliably, is relatively straightforward in terms of design and handling, and nowadays is established on the market owing to these advantages, among other things.

There is nonetheless a need to provide a honing tool of the type in question which comprises a reliably functioning honing tool retaining system, which can be provided with relatively straightforward design measures and is distinguished by straightforward handling during production and use.

SUMMARY

I provide a honing tool including a tool body that is tubular at least in certain portions and includes a cutting region with at least one honing stick receiving opening which is continuous from an interior of the tool body to outside and is adapted to receive a honing stick, wherein dimensions of the honing stick receiving opening and the honing stick are matched to one another such that the honing stick is received radially movably, and substantially without play in a circumferential direction of the tool body, between boundary surfaces of the honing stick receiving opening, a honing stick retaining system including at least one elastically compressible retaining element and in the installed state of the honing stick engages, with a pressing force generated by compressing the retaining element, on a boundary surface of the honing stick receiving opening such that the honing stick is held in the honing stick receiving opening by the honing stick retaining system, wherein the honing stick has at least one through-opening in a guide portion that interacts with the honing stick receiving opening, and the honing stick retaining system comprises a retaining device disposed in the through-opening and has at least one elastically deformable retaining element, and the retaining device is configured, in the installed state of the honing stick, to engage, with a pressing force generated by compressing the retaining element, on two mutually opposite boundary surfaces of the honing stick receiving opening such that the honing stick is held in the honing stick receiving opening by the honing stick retaining system.

I also provide a honing stick for use in a honing tool including a tool body, which is tubular at least in certain portions and includes a cutting region with at least one honing stick receiving opening which is continuous from the interior of the tool body to the outside and is intended for receiving a honing stick, wherein dimensions of the honing stick and dimensions of the honing stick receiving opening are matched to one another such that the honing stick is received radially movably, and substantially without play in the circumferential direction of the tool body, between boundary surfaces of the honing stick receiving opening, when to form a honing stick retaining system, the honing stick has, in a guide portion intended to interact with the honing stick receiving opening, at least one through-opening that receives a retaining device with at least one elastically deformable retaining element, and the retaining device is configured, in the installed state of the honing stick, to engage, with a pressing force generated by compressing the retaining element, on two mutually opposite boundary surfaces of the honing stick receiving opening such that the honing stick is held in the honing stick receiving opening by the honing stick retaining system.

BRIEF DESCRIPTION OF THE DRAWINGS

Further advantages and aspects of my honing tools and sticks will become apparent from the description of examples, which are explained below on the basis of the figures.

DETAILED DESCRIPTION

Figure 1:
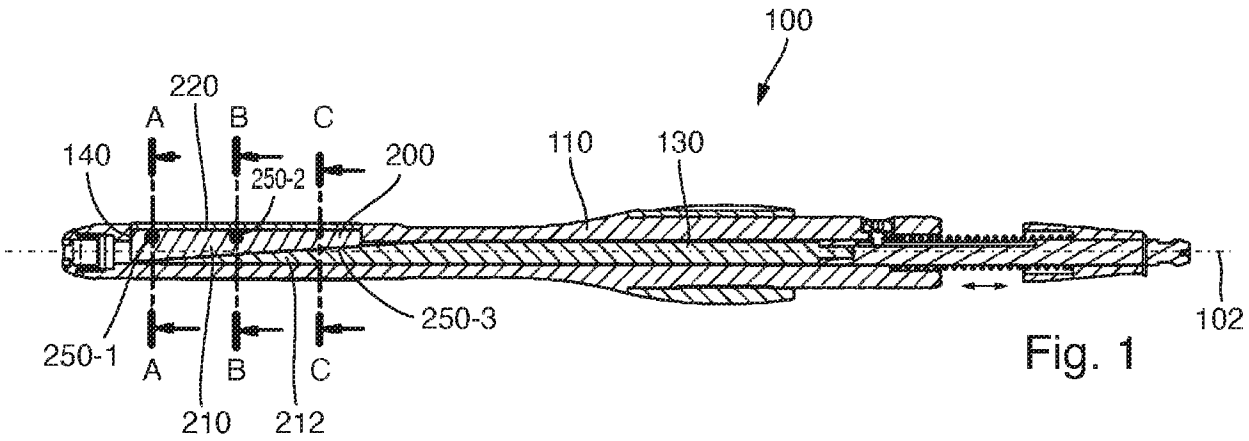
FIG. 1 shows a longitudinal section through a honing tool according to one example.

My honing tool comprises a tool body, which is tubular at least in certain portions and comprises a cutting region with at least one honing stick receiving opening which is continuous from the interior of the tool body to the outside and serves for receiving a single honing stick. The dimensions of the honing stick receiving opening and of the honing stick in the circumferential direction and preferably also in the axial direction are matched to one another such that the honing stick is received radially movably, and substantially without play in the circumferential direction of the tool body, between boundary surfaces of the honing stick receiving opening. The radial movability has the effect that the honing stick can be adjusted in the radial direction using an adjusting element, which is guided axially displaceably in the interior of the tool body, via interacting sloping surfaces when the adjusting element is axially displaced. The honing tool comprises a honing stick retaining system, which comprises at least one elastically compressible retaining element and in the installed state of the honing stick engages, with a pressing force generated by compressing the retaining element, on a boundary surface of the honing stick receiving opening such that the honing stick is held in the honing stick receiving opening by the honing stick retaining system.

The honing tool is characterized in that, in a guide portion intended to interact with the honing stick receiving opening, the honing stick has at least one through-opening which is continuous from one side surface to the other side surface of the guide portion, and the honing stick retaining system comprises a retaining device which is disposed in the through-opening and has at least one elastically deformable retaining element. The retaining device is configured such that, in the installed state of the honing stick, it can engage, with a pressing force generated by compressing the retaining element, on two mutually opposite boundary surfaces of the honing stick receiving opening such that the honing stick is held in the honing stick receiving opening by the honing stick retaining system.

This design has the effect that the retaining device disposed in the through-opening bears against both sides of the honing stick by way of the respective opposite boundary surface of the honing stick receiving opening under pretension, with the result that a frictional connection (force-fitting connection) is produced between the retaining device and the honing stick receiving opening. At the same time, the arrangement of the retaining device in the through-opening provides a form-fitting connection, which acts perpendicularly to the axial direction of the through-opening, between the retaining device and the honing stick. The form fit between the honing stick and the retaining device together with the frictional engagement between the retaining device and the tool body secures the honing stick against falling out of the honing stick receiving opening and captively in this respect, provided that forces do not act on the honing stick that can overcome the frictional engagement between the retaining device and the honing stick receiving opening.

These advantages can be achieved with design measures that can be carried out in relatively straightforward fashion. The through-opening can, for example, be realized by a preferably continuously cylindrical through-bore which passes through the guide portion and is significantly easier to produce in manufacturing technology terms than, for example, a milled receiving groove, which is provided in EP 2 364 813 A2. Moreover, numerous options for the configuration of the retaining device are offered.

Preferably, the honing stick has a width (measured between the side surfaces) in the region of the through-opening, and the retaining device, in the absence of external compressive forces, has a length which is greater than this width, with the result that the retaining device can be inserted into the through-opening such that, in the introduced and relaxed state, it can project beyond a side surface of the honing stick at both ends of the through-opening. If the honing stick is then inserted into the honing stick receiving opening, the length, measured in the longitudinal direction of the through-opening, of the retaining device decreases and pressing forces which press the retaining device on both sides against the boundary surfaces of the honing stick receiving opening are built up.

According to one example, the retaining device comprises at least one elastically deformable retaining element which, in a relaxed or force-free state, has an outside diameter which is greater than an inside diameter of the through-opening such that the retaining element can be introduced into the through-opening with elastic deformation and thus an associated decrease in its diameter and, in the introduced state, is automatically captively held in the through-opening by frictional engagement. "Captively" means in particular that the retaining element cannot fall out of the through-opening by itself, e.g., under the action of gravitational force. This straightforward fastening option, which makes do without the aid of tools, facilitates the assembly and handling of honing sticks configured in this way during transport, during installation in a tool body or during dismounting.

The elastically deformable retaining element, which with a change in shape can be inserted into the through-opening and is automatically held there may, for example, consist of an elastomer material or a rubber material. Elastomer refers to a dimensionally stable but elastically deformable plastic, as is used, for example, for sealing elements. Such retaining elements are commercially available in many dimensions and shapes, and therefore they can be used as retaining element optionally without modification. Many suitable elastomer materials are permanently resistant to all coolants and lubricants used during honing machining under routine machining conditions, and therefore the function of the honing stick retaining system is reliably present even after a relatively long period of use.

Particularly preferably, the retaining device comprises at least one elastically deformable retaining element in the form of a ball of an elastically deformable material. A ball, the outside diameter of which in the stress-free (uncompressed) state is somewhat greater than the diameter of the through-opening, can be pressed into the through-opening relatively easily with slight deformation and is automatically held there, expanding somewhat in the longitudinal direction of the through-opening. Balls are also easy to handle since they do not require a preferential installation orientation.

In some examples, the retaining device comprises precisely one ball of an elastically deformable material. In the relaxed state, the ball preferably has a diameter which is somewhat greater than the inside diameter of the through-opening, with the result that the ball, under slight compression, can be introduced into the through-opening and is automatically held there.

The use of a single ball of elastically deformable material as retaining device is advantageous in particular when the honing stick in the region of the through-opening has a width which is smaller than the diameter of the ball so that the ball can be inserted into the through-opening such that, in the introduced state, it can project beyond a side surface of the honing stick at both ends of the through-opening. In the inserted state of the honing stick, the ball is then in direct frictional contact with the mutually opposite boundary surfaces of the honing stick receiving opening. Therefore, among other things, particularly reliable frictional contact with the honing stick receiving opening is established since contact is established over its surface area and the coefficient of friction between elastomer materials and the metal material of the tool body is usually relatively high.

It is also possible to form a multi-part retaining device using at least one ball of an elastically deformable material and at least one further component. For example, an elastically deformable ball can be combined with a rigid support element, for example, manufactured from metal, with the result that the ball on one side of the honing stick and the support element on the other side of the honing stick are supported against the boundary surfaces of the honing stick receiving opening.

Preferred examples of retaining devices are, however, formed exclusively by one or more balls. Thus, for example, it can be expedient to dimension a through-opening such that its length in the width direction (between the side surfaces of the guide portion) is significantly greater than its diameter. In that example, the dimensions can be matched to one another, for example, such that the retaining device comprises multiple balls, in particular precisely two balls, of elastically deformable material, which are pushed into the through-opening in a row. The diameters of the balls may be somewhat greater than the inside diameter of the through-opening, with the result that they are readily held in the through-opening. The sum of the diameters of the balls should be somewhat greater than the length of the through-opening in the width direction, with the result that the last, or external, balls can project to a certain extent out of the through-opening on each side. In some examples, the retaining device consists of precisely two identically dimensioned balls of elastically deformable material.

As an alternative, a retaining device may have a helical compression spring which serves as retaining element, is manufactured, for example, from spring steel, can be compressed in its longitudinal direction (direction of the spring axis), can be inserted into the through-opening with its longitudinal direction approximately parallel to the longitudinal axis of the through-opening, and preferably at one end or at both ends comprises support elements, for example, of elastomer material and/or another plastic, which in the installed state are supported against the boundary surfaces of the honing stick receiving opening.

It can be sufficient for a honing stick to have a single through-opening with a correspondingly installed retaining device. In some examples, multiple through-openings are provided, for example, two or three or four or five through-openings distributed over the length of the honing stick. The through-openings may have identical diameters or different diameters. A respective retaining device may be disposed in multiple through-openings. It is not necessary for a retaining device to be disposed in every through-opening. Frequently, however, a respective retaining device is disposed in each of the through-openings. The holding forces and the spatial distribution thereof can be advantageously matched to requirements by way of the number and layout of the through-openings and the integrated retaining devices.

Figure 3:
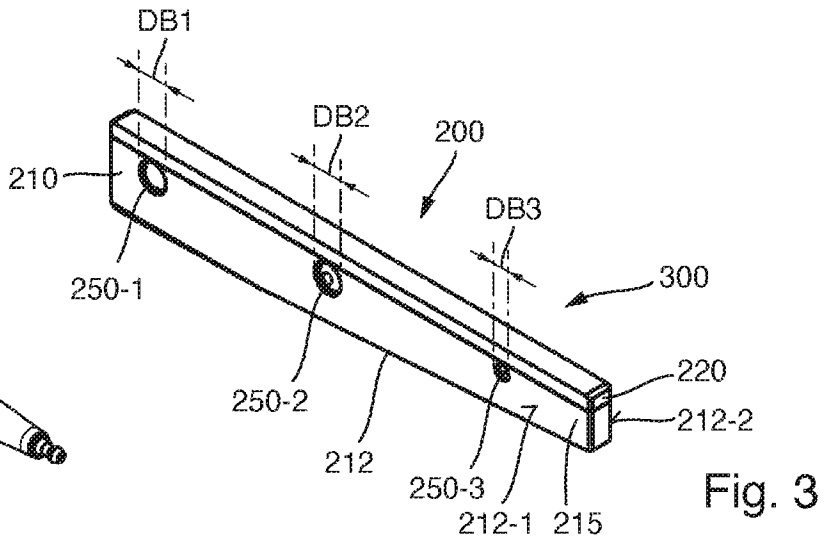
FIG. 3 shows an oblique perspective view of the honing stick of the honing tool from FIG. 1.
Figure 2:
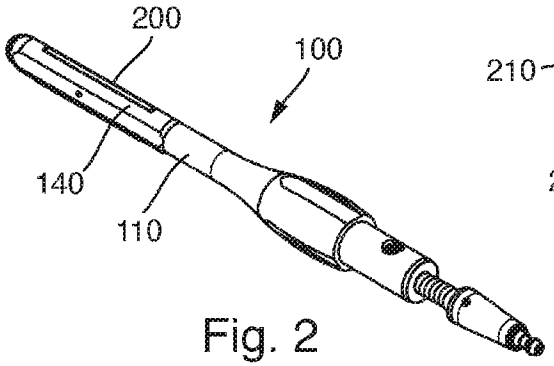
FIG. 2 shows an oblique perspective view of the honing tool from FIG. 1.

FIG. 1 shows a longitudinal section through one example of a honing tool 100 parallel to the tool axis (axis of rotation) 102 of the honing tool. FIG. 2 shows an oblique perspective view of the honing tool from FIG. 1. FIG. 3 shows an oblique perspective view of the honing stick of the honing tool from FIG. 1.

The honing tool is in the form of a single-stick honing tool and thus has only a single radially adjustable honing stick 200 in its cutting region. The honing tool has a tool body 110, which has approximately the shape of a tube which is open at both ends and has a relatively great wall thickness, with the outside diameter of the tube varying in certain portions in the axial direction.

The end portion of the tool body that is shown on the right in FIG. 1 serves to couple the honing tool 100 to the working spindle of a machine tool, in particular a honing machine. The cutting region of the honing tool, which for the honing machining is introduced into the interior of a bore that is to be machined, is in the opposite, free end portion of the tool body. In the cutting region, the tool body has a rectangular honing stick receiving opening 140, which is continuous from the interior of the tool body to the outside and in which a honing stick 200 is received in an accurate fit when the honing tool is being assembled. The axial length of the honing stick receiving opening is a multiple of the width measured in the circumferential direction.

The honing stick receiving opening 140 is delimited by four planar boundary surfaces which are parallel to one another in pairs. Two circumferentially acting, planar boundary surfaces, specifically a first boundary surface 140-1 and a second boundary surface 140-2 parallel thereto, are provided parallel to the axial direction. When the honing tool rotates in the direction of rotation DR (cf. FIG. 4A), the first boundary surface 140-1 leads and is referred to as leading boundary surface. The leading and the trailing boundary surface are each planar and run parallel to a plane which is spanned by the tool axis 102 and a radial direction running centrally between the lateral boundary surfaces 140-1, 140-2. In the axial direction, the honing stick receiving opening is delimited by an upper boundary surface and a lower boundary surface, which are each in a normal plane in relation to the tool axis 102.

On the opposite side to the honing stick receiving opening 140, two guide bars 180-1, 180-2 which are circumferentially offset with respect to one another by approximately 90° and consist of hard metal, sintered metal or another hard, for example, ceramic, material are mounted on the tool. They are supported by way of their smoothly polished, curved outer surfaces against the inner wall of the bore that is to be honed. The guide bars may bear a coating which consists of diamond, for example, and forms a wear-resistant outer surface.

The honing stick 200 is plate-shaped overall and has a plate-shaped backing element 210 of steel, which is frequently also referred to as backing strip. A cutting coat 220, which contains the bonded cutting material grains, is applied to the radial outer side of the backing element. In the example, the cutting coat 220 is sintered directly onto the planar outer side of the backing element, but in other examples may also be adhesively bonded on or soldered on or be fastened to the backing element by riveting or screwing. It is also possible that, between the cutting coat and the backing element, there is a flat sole that bears the cutting coat.

Formed on the radial inner side of the backing element 210 is a planar sloping surface 212, which interacts with a complementary planar sloping surface on the lower end of an adjusting rod 130, which is guided in the tool body, in the manner of a wedge drive such that the honing stick 200 inside the honing stick receiving opening 140 is pressed radially outward when the adjusting rod 130 is pressed in the direction of the cutting region of the honing tool by the adjusting drive accommodated in the honing machine.

That portion of the honing stick that in the installed state is between the lateral boundary surfaces 140-1, 140-2 of the honing stick receiving opening 140, is in contact with the boundary surfaces over its surface area and is slidingly guided by these surfaces during the radial movement, is referred to as guide portion 215. This guide portion includes a part of the backing element 210 and a smaller part of the cutting coat borne thereby, which thus projects to a certain depth into the honing stick receiving opening 140.

The dimensions of the honing stick 200 and the honing stick receiving opening 140 are matched to one another such that the honing stick is received radially movably, but substantially without play in the circumferential direction of the tool body, between the lateral boundary surfaces 140-1, 140-2. In the axial direction, that is to say between the upper and lower boundary surfaces, there may be a little play, although here as well a fit without play is provided as far as possible.

During the production of the honing stick and the tool body, it should be ensured that the clear distance between the leading and trailing boundary surfaces 140-1, 140-2 of the honing stick receiving opening is only minimally greater than the width BH of the honing stick, measured between the leading side surface 212-1 and the trailing side surface 212-2 of the honing stick or of the backing element. In the most favorable examples, a relatively fixed sliding fit should be produced, with the result that although the honing stick can be manually pressed into the honing stick receiving opening 140 from the outside during assembly, it cannot fall out of the honing stick receiving opening by itself. The honing stick should, however, be able to be displaced radially outward under the action of the downwardly pressed adjusting rod 130.

The honing tool is equipped with a honing stick retaining system 300, which provides reliable securing of an inserted honing stick against inadvertently falling out of the honing stick receiving opening 140. All components of the honing stick retaining system are formed on or fastened to the honing stick. In the example, the honing stick retaining system 300 includes three through-bores 250-1, 250-2, 250-3, which are introduced in the backing element 210 in the immediate vicinity of the cutting coat in the region of the guide portion 215 of the honing stick. The through-bores pass through the backing element 210 from one side surface 212-1 to the opposite side surface 212-2 in a direction (width direction) which runs tangentially (in the installed state).

Figure 4C:
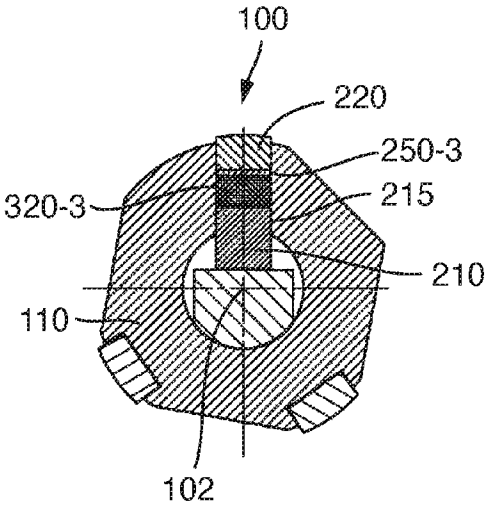
FIGS. 4A to 4C show sections, perpendicular to the tool axis, through the honing tool in the region of the three through-openings.
Figure 4B:
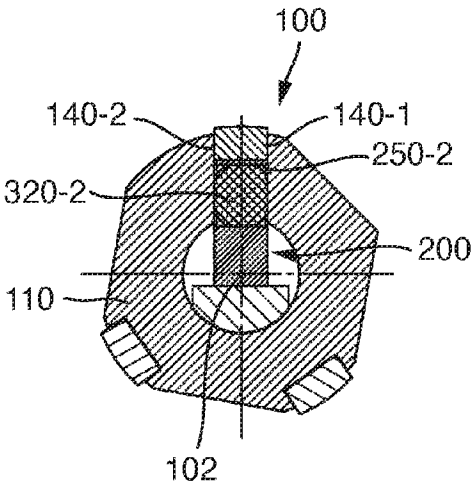
Figure 4A:
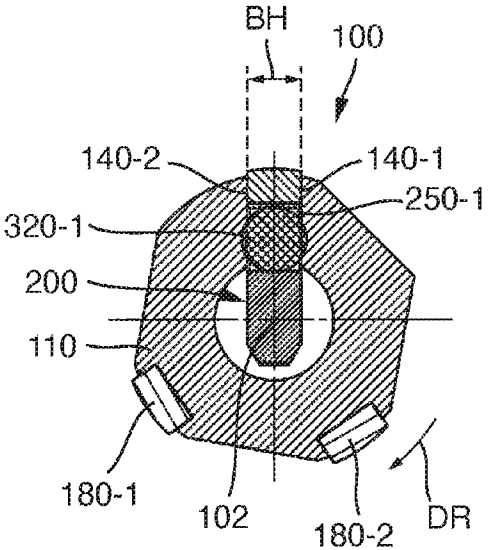

FIGS. 4A to 4C show sections perpendicular to the tool axis 102 through the honing tool 100 in the region of the three through-openings along the section lines A, B and C in FIG. 1. The two through-openings 250-1 and 250-2 that are further away from the spindle each have identical diameters DB1 and DB2, and the third through-opening 250-3 in the relatively narrow region of the backing element has a smaller diameter DB3, which is approximately only half the size.

A retaining device of the honing stick retaining system is disposed in each of the through-openings 250-*x*. In the region of the bores of larger diameter, each retaining device 320-1 and 320-2 consists of a single ball of an elastically compressible elastomer material, which is permanently resistant to the cooling lubricant of the honing machining. In the region of the third bore, the retaining device 320-3 consists of two identical elastically compressible balls of smaller diameter.

In any event, in the uncompressed state of the balls, the diameters of the balls are dimensioned such that they are somewhat greater than the inside diameters DB1, DB2 and DB3, with the result that, in the pressed-in state, they are automatically held in the through-bores 250-*x*. Furthermore, in the two large through-bores, the diameters of the bores and the balls inserted therein are dimensioned such that the diameter of the ball to be inserted is a few percent greater than the width BH of the honing stick, with the result that, in the centrally inserted state, in the region of both side surfaces the ball projects outward beyond the side surface by a few percent, for example, between 5% and 10% of the bore length (cf. FIG. 4A).

This has the result that, when the honing stick 200 equipped with the ball is introduced into the honing stick receiving opening 140, the ball is somewhat compressed in the width direction of the through-opening to be able to be introduced into the honing stick receiving opening. As can be clearly seen in FIG. 4B, this results in pressing surfaces which have a relatively large surface area and in which the compressed elastomer material of the ball is in direct touching contact with the leading and trailing boundary surfaces of the honing stick receiving opening 140. This ensures a secure frictional engagement between the retaining device formed by the ball and the honing stick receiving opening, or the tool body. At the same time, the clamped-in ball holds the honing stick 200 in a form fit in the radial direction and secures it against falling out. The ball acting as retaining element is thus supported on both opposite surfaces of the honing stick receiving opening and is captured in the honing stick 200 in a form fit, without play and under pretension.

The diameter DB3 of the through-bore 250-3 is significantly smaller than its length in the width direction (cf. FIG. 4C). The dimensions are adapted to one another such that the retaining device 250-3 is defined by two balls of identical size, the outside diameter of which in the relaxed state is somewhat greater than the inside diameter DB3 of the through-bore. Furthermore, the sum of the diameters is somewhat greater than the width of the honing stick in the region of the through-opening, with the result that the balls in the relaxed state project somewhat beyond the side surfaces and, upon being pushed into the honing stick receiving opening, are pressed inward somewhat so that the balls are elastically deformed and the restoring forces press the balls against the boundary surfaces on both sides of the honing stick receiving opening.

The solution approach explained here by way of example thus provides that one or more elastically compressible balls or the like are introduced captively in one or more through-bores in the honing stick. The (one or more) balls acting as retaining device are supported against the two opposite boundary surfaces of the honing stick receiving opening and in the process are captured in the honing stick in a form fit, without play and under pretension.

The ball or the balls can be mounted already in the production factory before the honing sticks are dispatched to a customer since the balls are captively captured in the honing stick by the pretension. As a result, there is no need for the customer to mount elements of the retaining device. The fully assembled honing stick can be preserved against corrosion inclusive of the installed balls since the material of the balls is resistant to swelling and/or decomposition with respect to many chemicals.

It is possible without great technical outlay to retrofit existing honing sticks of conventional design to afford honing sticks since it is merely necessary to make (one or more) through-bores in the backing strip and to press corresponding balls into the through-bores. The holding forces can be scaled by increasing or reducing the number of active balls. As a result of the high degree of osculation of the balls in the tangential region of the honing stick groove (honing stick receiving opening) in the tool, mounting without auxiliaries is readily possible and assists the end customer in mounting the honing stick without faults. The inserted balls can be precision-ground. In this way, it is possible for the desired diameter to have a precise tolerance to a few hundredths of a millimeter. In many examples, use can be made of conventional elastomer balls, as are also used, for example, in pneumatic non-return valves. The balls may, for example, be produced from a conventional sealing material, for example, nitrile butadiene rubber (NBR, also sold under the trade name Perbunan) or from a suitable fluoroelastomer as sold, for example, under the trade name Vitron. In my experience, these materials are permanently resistant to the cooling lubricants used in the honing sector.

A variation of or an adjustment to the exact pretension is, for example, possible by selection of the material of the ball (for example, by selection of balls of different hardnesses), by selection of the tolerance range for the diameters of the receiving bores for the balls, and/or by selection of the number of balls.

The invention claimed is:

1. A honing tool comprising:

a tool body that is tubular at least in certain portions and comprises a cutting region with at least one honing stick receiving opening which is continuous from an interior of the tool body to outside and is adapted to receive a honing stick, wherein dimensions of the honing stick receiving opening and the honing stick are matched to one another such that the honing stick is received radially movably, and without play in a circumferential direction of the tool body, between boundary surfaces of the honing stick receiving opening, a honing stick retaining system comprising at least one elastically compressible retaining element and in an installed state of the honing stick engages, with a pressing force generated by compressing the retaining element, on a boundary surface of the honing stick receiving opening such that the honing stick is held in the honing stick receiving opening by the honing stick retaining system, wherein the honing stick has at least one through-opening in a guide portion that interacts with the honing stick receiving opening, and the at least one elastically compressible retaining element is disposed in the at least one through-opening, and the at least one elastically compressible retaining element is configured, in the installed state of the honing stick, to engage, with the pressing force generated by compressing the at least one elastically compressible retaining element, on two mutually opposite boundary surfaces of the honing stick receiving opening such that the honing stick is held in the honing stick receiving opening by the honing stick retaining system;

wherein the at least one elastically compressible retaining element is in the form of a ball of an elastically deformable material.

2. The honing tool as claimed in claim 1, wherein the honing stick has a width in the region of the through-opening, and the at least one elastically compressible retaining element, in an absence of external compressive forces, has a length greater than the width, with the result that the at least one elastically compressible retaining element can be inserted into the at least one through-opening such that, in introduced and relaxed states, the at least one elastically compressible retaining element projects beyond a side surface of the honing stick at both ends of the through-opening.

3. The honing tool as claimed in claim 1, wherein the at least one elastically compressible retaining element which, in a relaxed state, has an outside diameter greater than an inside diameter of the at least one through-opening such that the at least one elastically compressible retaining element can be introduced into the at least one through-opening with elastic deformation and, in the introduced state, is automatically captively held in the at least one through-opening by frictional engagement.

4. The honing tool as claimed in claim 1, wherein the at least one elastically compressible retaining element is formed exclusively by one or more balls of the elastically deformable material.

5. The honing tool as claimed in claim 1, wherein the at least one elastically compressible retaining element comprises precisely one ball of the elastically deformable material, and the ball in a relaxed state has a diameter greater than an inside diameter of the at least one through-opening.

6. The honing tool as claimed in claim 5, wherein the honing stick in the region of the at least one through-opening has a width which is less than the diameter of the ball, with the result that the ball can be inserted into the at least one through-opening such that, in an introduced state, the ball projects beyond a side surface of the honing stick at both ends of the at least one through-opening.

7. The honing tool as claimed in claim 1, wherein a through-opening of the at least one through-opening of the honing stick has a length in a width direction greater than an inside diameter of the through-opening, and the at least one elastically compressible retaining element comprises multiple balls of the elastically deformable material which can be inserted into the through-opening in a row, diameters of the multiple balls are greater than the inside diameter of the through-opening such that the multiple balls are held in the through-opening, and a sum of the diameters of the multiple balls is greater than a length of the through-opening in the width direction such that the multiple balls in the row project beyond the through-opening on each side.

8. The honing tool as claimed in claim 1, wherein the at least one through-opening comprises multiple through-openings, two or three through-openings distributed over a length of the honing stick, and a respective at least one elastically compressible retaining element is disposed in each of the multiple through-openings.

* * * * *